United States Patent [19]

Moore

[11] 4,387,651

[45] Jun. 14, 1983

[54] REMOVABLE SEAL PLATES

[75] Inventor: Richard F. Moore, Tolland, Conn.

[73] Assignee: Combustion Engineering, Inc., Windsor, Conn.

[21] Appl. No.: 273,891

[22] PCT Filed: Jan. 2, 1981

[86] PCT No.: PCT/US81/00012

§ 371 Date: Jan. 2, 1981

§ 102(e) Date: Jan. 2, 1981

[87] PCT Pub. No.: WO82/02425

PCT Pub. Date: Jul. 22, 1982

[51] Int. Cl.[3] ..... F23J 1/02

[52] U.S. Cl. ..... 110/171; 110/166; 110/169; 126/242

[58] Field of Search ..... 110/171, 169, 166, 165 R, 110/170; 126/242

[56] References Cited

U.S. PATENT DOCUMENTS

| | | | |
|---|---|---|---|
| 1,169,017 | 1/1916 | Duckham | 110/171 |
| 1,867,794 | 7/1932 | Allen | 110/171 |
| 3,094,953 | 6/1963 | Alexander | 110/171 |
| 3,915,105 | 10/1975 | Michelbrink | 110/171 |
| 4,300,457 | 11/1981 | Moore | 110/171 |

*Primary Examiner*—Larry Jones

*Attorney, Agent, or Firm*—Robert L. Olson

[57] ABSTRACT

Apparatus for handling ash and slag produced in the combustion of coal or other ash-bearing fuel in the furnace (10) (not shown) of a steam generator, including a submerged scraper conveyor (20) beneath the furnace, and a water seal including plate means (24) extending from the furnace bottom or transition chute into the water (18) in the tank (16) housing the scraper conveyor, which plate means (24) also form a seal at their upper ends (40,42) with the furnace bottom or transition chute, for preventing the atmosphere from being exposed to the furnace interior. A motor (50,52) is provided for moving the plate means (24) upwardly and downwardly, to allow the submerged scraper conveyor (20) and its tank (16) to be quickly removed from beneath the furnace (10) when the unit is shut down for maintenance purposes.

4 Claims, 2 Drawing Figures

REMOVABLE SEAL PLATES

BACKGROUND OF THE INVENTION

In coal-fired steam generators, the manner in which the ash is handled and disposed of is an item of considerable importance. One means used today for continuously removing ash and slag which falls through an opening in the furnace bottom is a scraper conveyor which is submerged in a tank of water. When the unit is shut down for periodic maintenance, it is desirable to be able to move the entire scraper conveyor unit, including the tank in which it is housed, from beneath the furnace so that it can be easily worked on, and so that it can be replaced with another unit if major repair is required.

A water seal is generally provided for preventing the atmosphere from being exposed to the furnace interior. This consists of a plate extending down and surrounding the furnace bottom opening, which plate extends into the submerged scraper conveyor tank, which tank is filled with water, thus forming a water seal. This type of seal is provided because it allows the furnace to grow relative to the submerged scraper conveyor unit caused by thermal expansion. Large furnaces are generally top supported, so that they are free to expand in a downward direction when the unit is first started up. This growth can be on the order of 10–12" from the cold to the hot condition.

The above provides the problem of how to be able to quickly remove the submerged scraper conveyor unit from beneath the furnace when the unit is shut down for maintenance. In the past, it has been necessary to allow the unit to cool down to a point where workmen can unbolt the seal plate from the furnace bottom. This cooling and unbolting time is considerable and can cause the entire steam generator to be down for lengthy maintenance periods.

SUMMARY OF THE INVENTION

In accordance with the invention, a submerged scraper conveyor unit is provided beneath a coal-fired furnace and a water seal is provided therebetween to prevent the furnace gases from escaping to the atmosphere. This water seal is formed by providing plate means extending down from the furnace bottom into the water-filled submerged scraper conveyor tank. The upper end of the plate means forms a seal with the furnace bottom. The plate means are capable of being moved upwardly and downwardly by a hydraulic or electric motor so that it can be moved downwardly into sealing relationship during operation of the furnace, and can be moved to its up position during a maintenance shutdown so as to permit the submerged scraper conveyor tank to be removed from under the furnace.

DESCRIPTION OF THE PREFERRED EMBODIMENT

Figure 1:
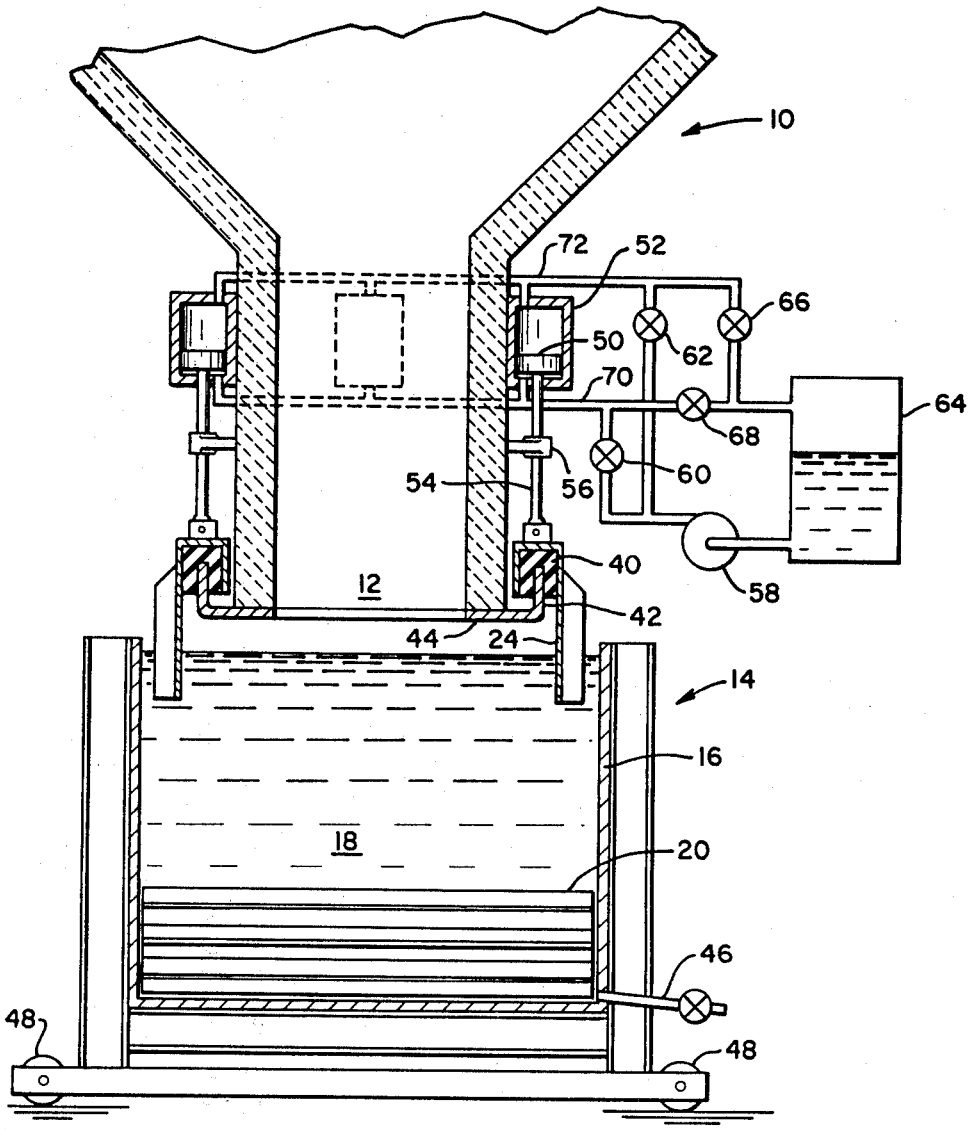
FIG. 1 is a sectional side view of a submerged scraper conveyor unit and its associated furnace constructed in accordance with the invention.
Figure 2:
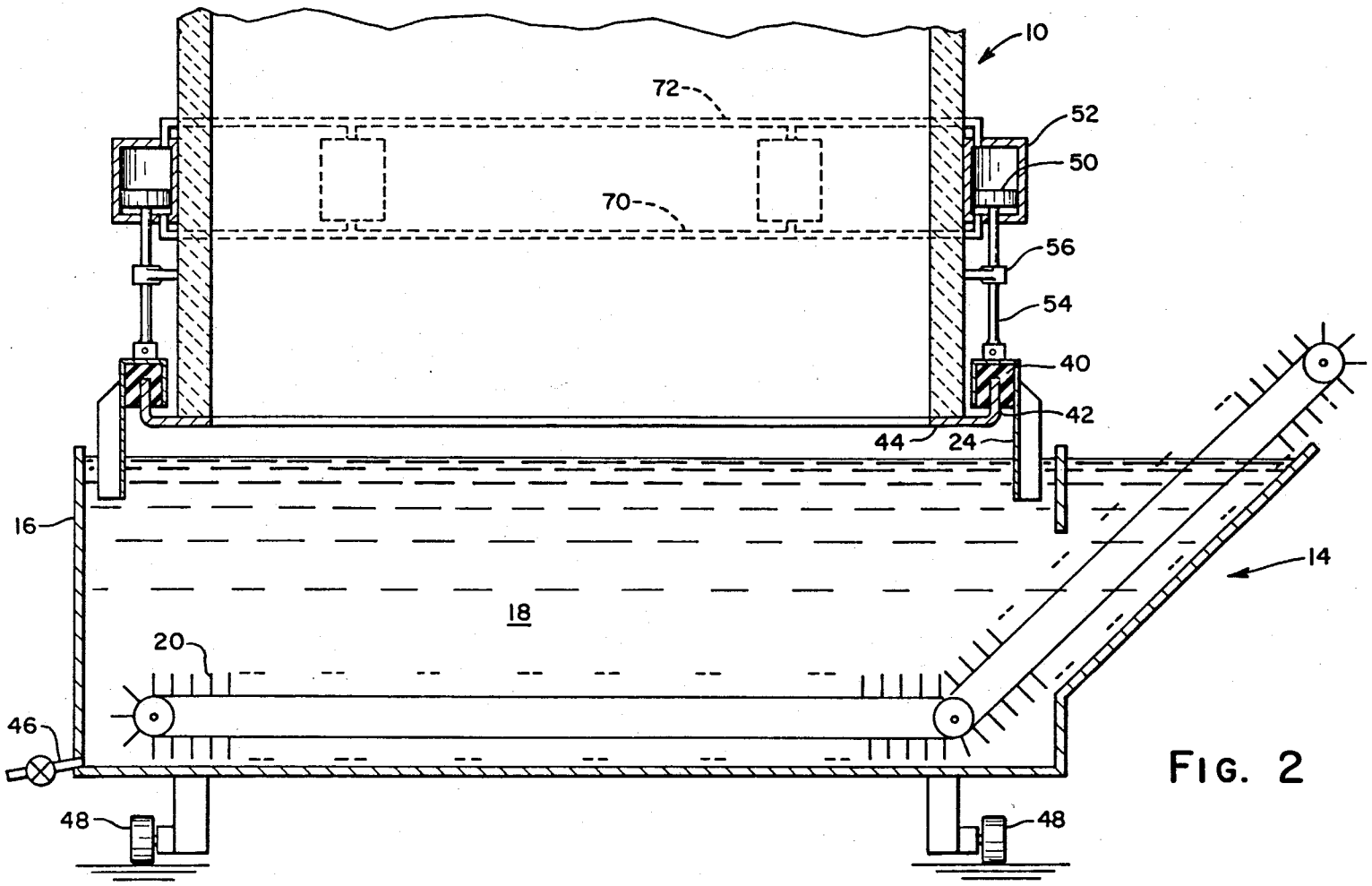
FIG. 2 is a view taken on line 2—2 of FIG. 1.

Looking now to the drawings, numeral 10 designates a furnace or a transition chute which is attached to a furnace of a steam generator in which coal is burned. Molten ash and slag are discharged through the furnace bottom or transition chute opening 12, and falls into the submerged scraper conveyor unit 14. The tank 16 is filled with water 18 and contains a conveyor belt 20 with integral scraper blades in the bottom thereof, by means of which the cooled ash and slag is continuously removed from the tank (FIG. 2). The upper run of the conveyor 20 carries the clinkers to the end of the tank, where they can be discharged into trucks or onto a mechanical conveyor (not shown) and transported away. A portion of the water in the tank is constantly removed and replenished (while maintaining a given water level) to maintain the main body of water at a temperature not exceeding 160° F.

A water seal permits thermal expansion of the top-supported furnace 10 while preventing exposure of the interior thereof to the atmosphere. The water seal is formed by plate 24 which is secured to the bottom of the furnace and extends downwardly into the water in tank 16. The plate 24 extends around the entire periphery of the opening 12, so as to completely seal the opening between the furnace 10 and the submerged scraper conveyor unit 14. During operation of the furnace, the plate 24 extends downwardly into the water in tank 16 so as to form the seal. In addition, a movable neoprene gasket 40 cooperates with the stationary rim 42, to form a seal at the furnace bottom end. As in the case of plate 24, both the rim 42 and gasket 40 extend around the entire periphery of the opening 12 so as to completely seal the opening when in its sealing position. The gasket 40 is attached to the plate 24, and is thus movable with it. Rim 42 is attached to the furnace 10 by means of an imperforate metal skirt member 44.

The tank 16 is provided with a drain 46, so that it can be emptied during a maintenance shutdown. The tank is also mounted on wheels 48, so that it can be quickly moved from beneath the furnace 10 during a shutdown. The plate 24 and gasket 40 are motor actuated, so that during furnace operation they are in their lower position in sealing relationship with the water in tank 16, and rim 42 respectively. When it is desired to move the tank 16, during a maintenance shutdown, the plate 24 and gasket 40 are moved to their upper positions, so that the plate is located above the upper edge of tank 16 and it will clear the plate 24 during sideways movement in either direction.

The gasket 40 and plate 24 are secured to a piston-cylinder arrangement 50, 52, by rods 54. The rods 54 are supported and guided by lateral guide members 56 which are secured to the furnace, and prevent any lateral movement of the various members. Hydraulic fluid can be pumped by pump 58 beneath the pistons 50 through valve 60 and above the pistons through valve 62. Fluid can return to the storage or sump tank 64 from above and below the pistons 50 through valves 66 and 68, respectively. As shown in FIG. 2, there are two piston-cylinder arrangements located on each of the four sides of the furnace bottom, so that the gasket 40 and plate 24 move up and down smoothly without binding. All eight of the piston-cylinders are supplied and drained of hydraulic fluid through lines 70 and 72, which extend all the way around the furnace bottom.

The manner in which the water seal is operated should now be apparent. When it is desired to move the submerged scraper conveyor unit from beneath the furnace 10, the pump 58 is actuated and valves 60 and 66 are opened. Valve 60 permits fluid to flow through hydraulic line 70, forcing the pistons 50 upwardly. Limit switches (not shown) which are actuated by the plate 24 can be used to stop the pump 58 and close the valves when the plate is in its proper upper or lower position, as the case may be. When plate 24 is in sealing relationship with the water 18, then intermediate seal member or gasket 40 is in sealing engagement with rim 42. During the opposite operation, gasket 40 is in its up position, out of contact with rim 42. Tank 16 is drained of water through valve 46 and the tank 16 can then be moved from beneath the furnace 10 to be worked on. If major work is required, a second or spare tank can be placed beneath the furnace while the other one is being fixed or repaired.

When the unit is to be put back into operation, the tank 16 is first positioned beneath the furnace 10. Pump 58 is actuated, and valves 62 and 68 are opened. Valve 62 admits fluid to line 72, forcing pistons 50 downwardly while fluid drains from line 70 into the sump 64 through valve 68. Tank 16 is meanwhile being filled with water. The furnace can thereafter be fired with coal or other ash-bearing fuel.

I claim:

1. An ash-disposal system for ashes discharged from a coal-fired or other ash-bearing fuel-fired combustion chamber, including opening means in the furnace bottom, a tank opened at its upper end and containing water positioned beneath the opening means, into which the ash from the combustion chamber falls, means for removing the ash from the tank, a water seal between the furnace bottom and the tank for sealing the furance interior from exposure to the atmosphere, the water seal including plate means movably attached to and extending down from the furnace bottom, which plate means completely surrounds the opening means, said plate means having first and second positions, the first position being such that the plate means extend down into the water within the tank at their lower ends, said opening means in the furnace bottom having an annular ring attached to it, and said plate means having a resilient seal attached to it, which resilient seal is in sealing contact with the ring when the plate means is in its first position, and the second position being such that the tank is located beneath the plate means and the resilient seal is not in sealing relationship at the upper end with the opening means ring in the furnace bottom, and means for moving the plate means between the first and second positions.

2. The ash-disposal system set forth in claim 1, wherein the means for moving the plate means between its first and second positions is a piston-cylinder actuator means.

3. The ash-disposal system set forth in claim 2, wherein the tank is mounted on wheels.

4. The ash-disposal system set forth in claim 3, wherein the piston-cylinder actuator means consists of a pair of piston-cylinders on each of the four sides of the furnace bottom.

* * * * *